US008487786B1

(12) United States Patent
Hussey et al.

(10) Patent No.: US 8,487,786 B1
(45) Date of Patent: Jul. 16, 2013

(54) AIRCRAFT DISPLAY SYSTEM AND METHOD

(75) Inventors: Scott A. Hussey, Milwaukie, OR (US); Gary C. Bailey, Beaverton, OR (US); David J. Swan, Canby, OR (US); Khai M. Do, Tigard, OR (US)

(73) Assignee: Rockwell Collins, Inc., Cedar Rapid, IA (US)

( * ) Notice: Subject to any disclaimer, the term of this patent is extended or adjusted under 35 U.S.C. 154(b) by 386 days.

(21) Appl. No.: 12/874,004

(22) Filed: Sep. 1, 2010

(51) Int. Cl.
*G08G 5/00* (2006.01)
*G09G 3/36* (2006.01)

(52) U.S. Cl.
USPC ..... 340/955; 340/956; 345/102

(58) Field of Classification Search
USPC ..... 340/945, 953, 955, 956, 963, 971, 340/980; 345/102, 158, 173, 207, 74.1, 76; 349/42, 65, 106, 112; 372/29.02, 29.021; 353/84, 112
See application file for complete search history.

(56) References Cited

U.S. PATENT DOCUMENTS

| | | | | |
|---|---|---|---|---|
| 4,997,263 | A * | 3/1991 | Cohen et al. | 349/11 |
| 5,629,784 | A * | 5/1997 | Abileah et al. | 349/112 |
| 5,831,693 | A * | 11/1998 | McCartney et al. | 349/42 |
| 6,987,787 | B1 * | 1/2006 | Mick | 372/29.021 |
| 7,312,779 | B1 * | 12/2007 | Blevins | 345/102 |

* cited by examiner

*Primary Examiner* — Van T. Trieu
(74) *Attorney, Agent, or Firm* — Donna P. Suchy; Daniel M. Barbieri

(57) ABSTRACT

An aircraft display system includes an electronic display configured to provide at least one of graphical and textual elements and electronics configured to receive a signal indicating an ambient light level. The electronics set a brightness of the display using a first calculation in response to a desired contrast ratio and the ambient light level and using a second calculation in response to the desired contrast ratio and the ambient light level.

20 Claims, 5 Drawing Sheets

AIRCRAFT DISPLAY SYSTEM AND METHOD

BACKGROUND

The present disclosure relates generally to the field of display systems. More particularly, the disclosure relates to the automatic brightness control of electronic display systems for use in aircraft and that may be used in low ambient light conditions.

Aircraft pilots and crew conventionally have difficulty viewing electronic displays in low ambient conditions. Auto brightness systems may not always respond appropriately to a change to low ambient light. When the display brightness is placed into automatic brightness mode, the display graphics and/or text may not be as visible in low ambient light conditions as compared to higher ambient light conditions with the same contrast ratio. This is because the human eye loses effectiveness in low ambient light conditions.

There is a need for an improved display system and method that can compensate for the effectiveness of the human eye in low ambient light conditions. There is also a need for a display system and method configured to adjust the contrast ratio or brightness of the display in low ambient light conditions and in normal ambient light conditions. There is further a need for a display system and method that provides increased readability in low ambient light conditions.

SUMMARY

According to one exemplary embodiment, an aircraft display system includes an electronic display configured to provide at least one of graphical and textual elements and electronics configured to receive a signal indicating an ambient light level. The electronics set a brightness of the display using a first calculation in response to the desired contrast ratio and the ambient light level and using a second calculation in response to the desired contrast ratio and the ambient light level.

According to another exemplary embodiment, a method for setting a brightness of an aircraft display includes receiving a signal indicating an ambient light level at electronics, receiving a signal indicating a desired contrast ratio against ambient light level for the display at the electronics, and setting a brightness of the display using the electronics. The electronics uses a first calculation in response to the desired contrast ratio and the ambient light level and uses a second calculation in response to the desired contrast ratio and the ambient light level.

According to another exemplary embodiment, an aircraft display system includes means for receiving a signal indicating an ambient light level, means for receiving a signal indicating a desired contrast ratio against ambient light level for the display, and means for setting a brightness of the display using a first calculation in response to the desired contrast ratio and the ambient light level and using a second calculation in response to the desired contrast ratio and the ambient light level.

It is to be understood that both the foregoing general description and the following detailed description are exemplary and explanatory only, and are not restrictive of the invention as claimed.

BRIEF DESCRIPTION OF THE DRAWINGS

These and other features, aspects, and advantages of the present disclosure will become apparent from the following description, appended claims, and the accompanying exemplary embodiments shown in the drawings, which are briefly described below.

DETAILED DESCRIPTION

Figure 1:
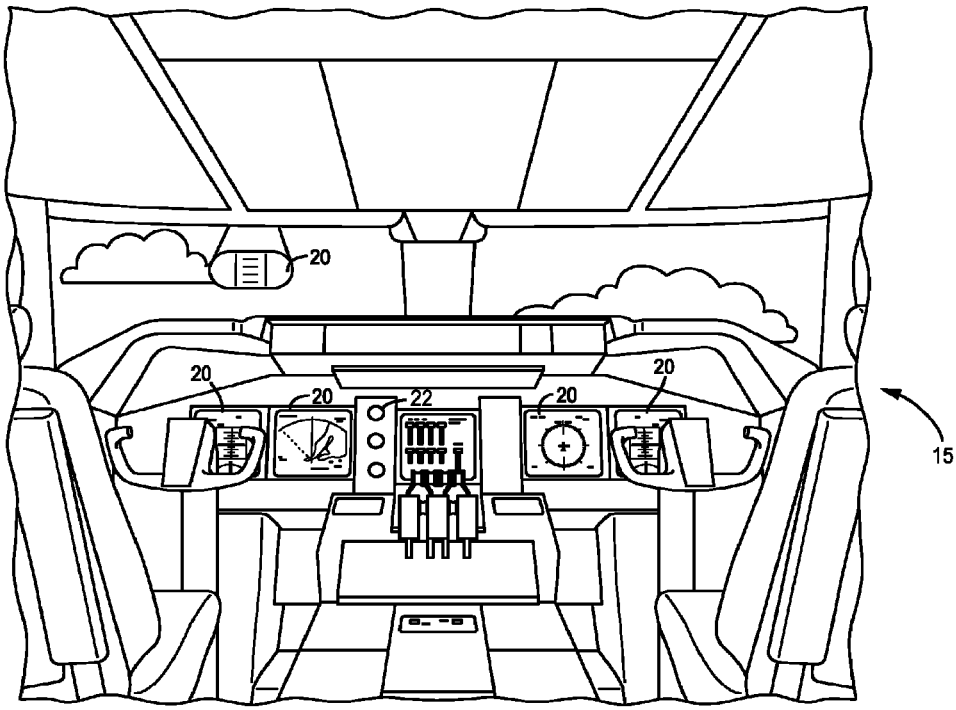
FIG. 1 is an illustration of a control center or cockpit for an aircraft, according to an exemplary embodiment.

Before describing in detail the particular improved system and method, it should be observed that the invention includes, but is not limited to, a novel structural combination of conventional data/signal processing components and display components, and not in the particular detailed configurations thereof. Accordingly, the structure, methods, functions, control and arrangement of conventional components software, and circuits have, for the most part, been illustrated in the drawings by readily understandable block representations and schematic diagrams, in order not to obscure the disclosure with structural details which will be readily apparent to those skilled in the art, having the benefit of the description herein. Further, the invention is not limited to the particular embodiments depicted in the exemplary diagrams, but should be construed in accordance with the language in the claims.

Referring generally to the figures, a system and method for adjusting a display brightness of an aircraft display is shown. The system can include an electronic display, user interface elements, an ambient light sensor, and electronics. The electronic display can be any type of display, including but not limited to primary displays, head down displays (HDDs), head up display (HUDs), secondary displays, head worn displays, etc. The system may operate in a manual brightness control mode or an automatic brightness control mode. In the manual mode, the user interface elements may be used to directly control the display brightness level. In the automatic mode, the electronics may use a sensed ambient light level from the sensor to adjust the display brightness for a desired contrast ratio set using the user interface elements. The electronics may make one calculation for low ambient light level conditions and another calculation for normal or high ambient light level conditions. The electronics may perform both calculations and select the higher calculated display brightness for use in adjusting the brightness of the electronic display.

Referring to FIG. 1, an illustration of a control center or cockpit 15 for an aircraft 10 is shown, according to one exemplary embodiment. Aircraft control center 15 includes flight displays 20. Flight displays 20 can be used to provide information to the flight crew, thereby increasing visual range and enhancing decision-making abilities. According to an exemplary embodiment, at least one of the displays of the flight displays 20 is configured to provide an indication to a flight crew for guidance or navigation. For example, display 20 may provide indications related to traffic collision avoidance, tailstrike avoidance, runway approach, aircraft takeoff, low visibility guidance, terrain avoidance, runway incursion avoidance, other hazard avoidance, runway/taxiway navigation, flight navigation, etc.

In some exemplary embodiments, flight displays 20 can provide an output from other systems of the aircraft. Displays 20 can include a weather display, a joint display, a weather radar map, a terrain display, and a head up display. Further, displays 20 may include an electronic display. For example, flight displays 20 can include a display configured to display a three dimensional or two dimensional perspective image of terrain, weather, navigation, or guidance information. Other views of terrain, weather, guidance, and navigation information may also be provided (e.g. plan view, horizontal view, vertical view, etc.). Additionally, flight displays 20 can be implemented using any of a variety of display technologies, including CRT, LCD, organic LED, dot matrix display, TFT, and others.

In various exemplary embodiments, flight displays 20 can also include head up displays (HUD) with or without a projector. The HUD is generally configured to display at least one of graphical and textual images or indicia. The images or indicia are displayed onto an otherwise generally transparent medium or combiner that the flight crew can see through. For example, the HUD may display navigational or guidance data overlayed onto a runway that the flight crew is viewing. The images may also be overlayed onto a view of terrain, other aircraft, cloud cover, low visibility conditions, other hazards, etc. In other exemplary embodiments, the medium on which the images are displayed may provide a synthetic view of various objects. For example, the medium may display an image of a runway, terrain, an obstacle, other aircraft, etc. that may or may not be otherwise viewable by the flight crew.

Aircraft control center 15 additionally includes one or more user interface (UI) elements 22. UI elements 22 can include dials, switches, buttons, touch screens, mous devices, trackballs, joysticks, or any other user input device. UI elements 22 can be used to adjust features of flight displays 20, such as contrast, brightness, width, and length. UI elements 22 can also (or alternatively) be used by an occupant to interface with or change the displays of flight displays 20. UI elements 22 can additionally be used to acknowledge or dismiss an indicator provided by flight displays 20. Further, UI elements 22 can be used to correct errors on the electronic display.

One specific UI element 22 may be used to set a manual or automatic mode for brightness and contrast adjustments of display 20 (e.g., an HUD or other display). Another specific UI element or knob may be used to adjust the brightness or contrast of display 20 based on the manual or automatic mode. If the manual mode is set, the knob may be used to directly adjust a fixed brightness of display 20. If the automatic mode is set, the knob may be used to set a desired contrast ratio that automatically adjusts the display brightness based on the ambient light level around the display, as is discussed in greater detail below.

Figure 2:
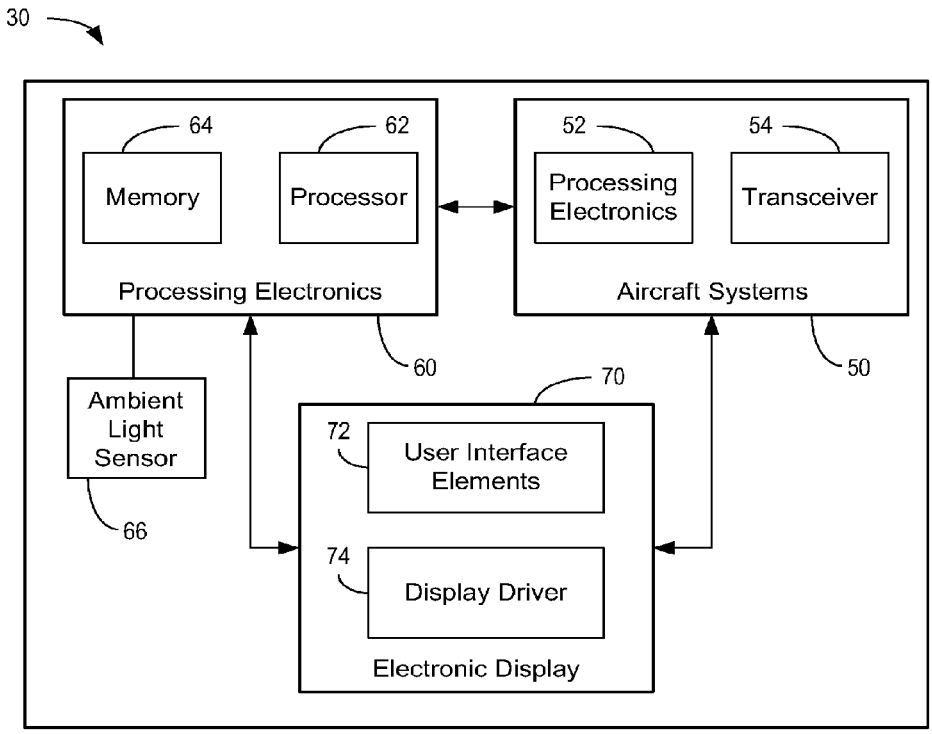
FIG. 2 is a schematic block diagram of an aircraft display system, according to an exemplary embodiment.

Referring to FIG. 2, a display system 30 is configured to provide graphical and/or textual representations of flight data to the flight crew, according to an exemplary embodiment. Display system 30 includes aircraft systems 50, processing electronics 60, and an electronic display 70. Aircraft systems 50 are generally configured to provide data to processing electronics 60 for further processing and/or to electronic display 70 for illustration to the flight crew.

According to various exemplary embodiments, aircraft systems 50 may include at least one of a radar system, a communications system, a terrain awareness system, a navigation system, and any other aircraft system that generates data that may be useful to the flight crew. In an exemplary embodiment using a radar system, weather data, terrain data, and/or aircraft data may be provided for display on electronic display 70. In an exemplary embodiment using a communication system, communication data from a ground station or other aircraft (e.g., navigational data, weather data, communication messages, etc.) may be provided for display on electronic display 70. In an exemplary embodiment using a terrain awareness system, terrain data and/or obstacle data may be provided for display on electronic display 70. In an exemplary embodiment using a navigation system, navigational data (e.g., location, elevation, heading, bearing, drift, flight path, etc.) may be provided for display on electronic display 70.

Each aircraft system may generally include a transceiver 52 configured to send and receive data (e.g., radar data, terrain data, communication data, etc.) or to communicate with processing electronics 60 and display 70. Each aircraft system may also include processing electronics 54 configured to perform operations on received data or to format data for sending to processing electronics 60 or display 70.

Electronic display system 70 can be used to display information from aircraft systems 50 or other electronic equipment. Electronic display system 70 may include user interface (UI) elements 72, display 20, and a display driver 74. Display driver 74 can be any computer hardware and/or software that enables electronic display system 70 to communicate with and receive data from various other components. As described above, display 20 may be a head up display, a TFT display, an LCD display, or any other display suitable for use in an aircraft. UI elements 72 (e.g., knob, dial, button, touch screen, etc.) can be used for adjustment of display properties such as contrast, brightness level, dimensions, etc. As described above, UI elements 72 may include an element for setting a manual or automatic brightness control mode and an element (e.g., a knob or other element) for adjusting the brightness or contrast ratio based on the mode. UI elements 72 can also be used for selection of data shown on display 20 or to apply corrections to data shown on display 20. Input received from UI elements 72 may be provided directly to processing electronics 60 for further processing. Alternatively, input received from UI elements 72 may be processed by display driver 74. Display driver 74 may then communicate the received input to processing electronics 60 or various other components.

Processing electronics 60 may be configured to perform operations on data received from aircraft systems 50 or from UI elements 72. Processing electronics 60 may be configured to verify data received from aircraft systems 50 or to facilitate transmission of data to display 70 or to a ground station or another aircraft. Processing electronics 60 includes a processor 62 and a memory 64. Processor 62 may be any hardware and/or software processor or processing architecture capable of executing instructions (e.g., computer code stored in memory 64) and operating on various data types. Memory 64 may be any volatile or non volatile memory configured to store instructions or operations for execution by processor 62. Alternatively, memory 64 may be configured to store radar data received from aircraft systems 50, a ground station, or from another aircraft.

In addition to providing data to display 70 for display, processing electronics 60 may be able to adjust properties of display 70. For example, processing electronics 60 may adjust the contrast ratio, brightness, resolution, or other properties of display 70. Processing electronics may communicate with an ambient light sensor (ALS) 66 to receive data related to an ambient light level in the aircraft, for example in the cockpit or near the display. For purposes of this disclosure an area near the display may be a distance within ten feet of the display, within five feet of the display, within three feet of the display, within one foot of the display, etc. ALS 66 may be any ALS sensor capable of measuring ambient light in an aircraft cockpit. ALS 66 may be located in a combiner of display 70 (e.g., for a HUD) or in any other location of display system 30. ALS 66 may have the same field of view as the combiner field of view. ALS 66 then feeds a DC voltage back to the processing electronics 60 (e.g., in a range between about 0 to 5 volts). Processing electronics 60 then scales the DC voltage into foot lamberts using the following equation:

$$\text{Ambient Light(fL)}=K1\times 10^{(K2\times \textit{Ambient Light VDC}-1)} \quad (1)$$

Where K1 and K2 are calibration parameters. In one exemplary embodiments, equation (1) may be used for an ALS 66 using a voltage range of about 0 to 5V. In other exemplary embodiments, ALS 66 may have a different operating voltage range. In various exemplary embodiments, the calibration parameters or coefficients K1 and K2 allow equation (1) to be calibrated or tuned for various types of ALS 66.

Based on the ambient light level, processing electronics 60 may adjust the contrast ratio or display brightness of display 70. Adjustments of the contrast ratio or display brightness of display 70 may be calculated based on inputs received at UI elements 72. If the display system is set to an automatic brightness control mode, in typical or normal ambient light conditions processing electronics 60 may adjust the contrast ratio or brightness based on one calculation and adjust the contrast ratio or brightness in low ambient light conditions based on another calculation, as described in greater detail below.

Figure 3:
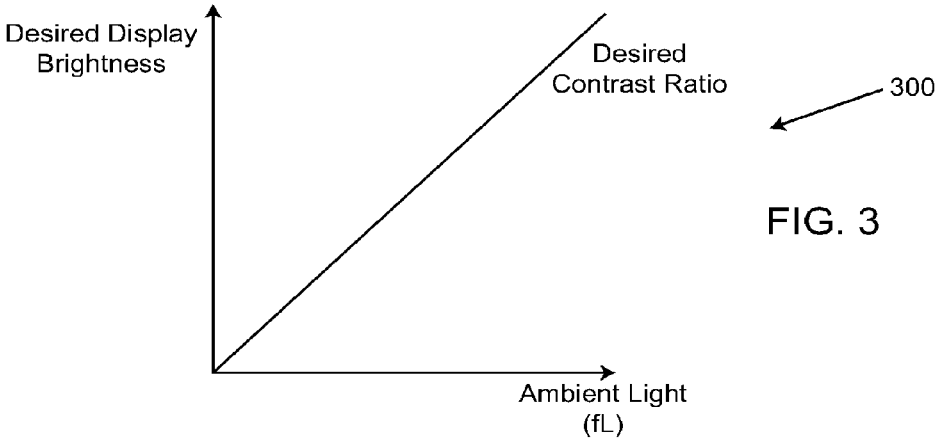
FIG. 3 is a graph illustrating adjustment of a display contrast ratio for normal ambient light conditions, according to an exemplary embodiment.
Figure 4:
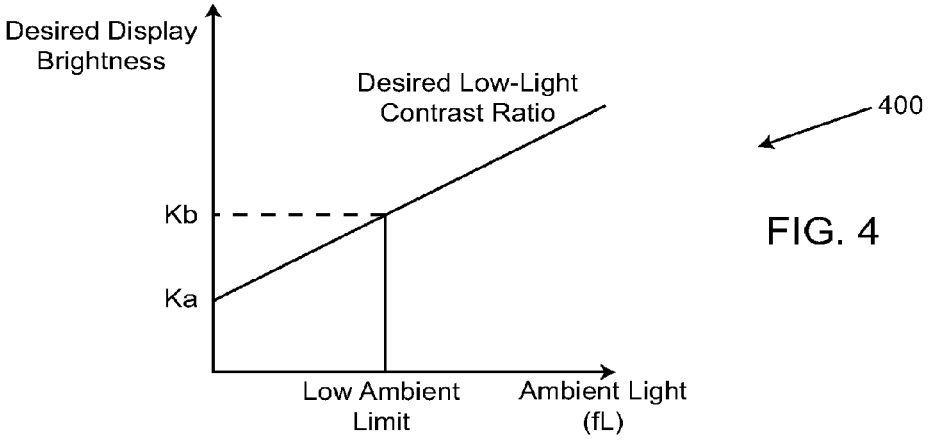
FIG. 4 is a graph illustrating adjustment of a display contrast ratio for low ambient light conditions, according to an exemplary embodiment.
Figure 5:
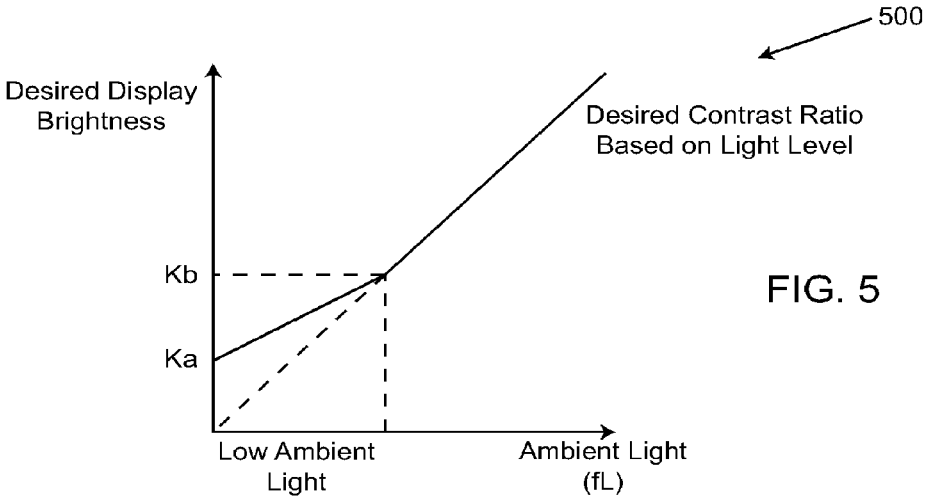
FIG. 5 is a graph illustrating adjustment of a display contrast ratio for low ambient light conditions and normal ambient light conditions, according to an exemplary embodiment.

Referring also to FIGS. 3-5, the automatic brightness control mode is described in greater detail, according to an exemplary embodiment. It is noted that to simplify the explanation of the automatic brightness control mode, the equations shown are generally written in linear form. However, it should be understood that actual brightnesss and ambient light may be calculated logarithmically. The human eye observes an exponential increase in brightness as being linear.

When the brightness of display 70 is set to automatic mode, the desired display brightness is calculated based on a desired contrast ratio set by the pilot or flight crew via a display brightness knob (e.g., a UI element 22 or 72). The desired display brightness can vary with the sensed ambient light level to maintain the desired contrast ratio:

$$\text{Desired Contrast Ratio}=1+(\text{Desired Display Brightness/Ambient Light}) \quad (2)$$

Processing electronics 60 calculates the desired display brightness based on the desired contrast ratio using the following general equation:

$$\text{Desired Display Brightness}=(\text{Desired Contrast Ratio}-1)\times\text{Ambient Light} \quad (3)$$

The ambient light is measured by ALS 66 as described above. ALS 66 generally has the same field of view (in size and shape) as display 70 (e.g., a combiner for a HUD).

Referring specifically to FIG. 3, according to one exemplary embodiment, there is one brightness response 300 for display 70. When in automatic brightness control mode, the pilot or flight crew can set the desired contrast ratio using the brightness knob (UI element 22, 72) located on display 70 (e.g., on the combiner). Processing electronics 60 maintains the desired contrast ratio by calculating the desired display brightness based on the sensed ambient light level using equation (3) above.

Referring to FIG. 4, according to another exemplary embodiment, when the ambient light condition reduces below an eye effectiveness threshold, it may be beneficial to increase the contrast ratio according to a brightness response 400. The lower the ambient light, the higher contrast ratio may be required to allow the human eye to see graphics, text, or symbology on display 70. Equation (3) above for calculating the desired display brightness may no longer be adequate for computing the desired display brightness when the ambient light is low. In various exemplary embodiments, the low ambient light may be based off of what the desired contrast ratio is set to, and can range from the lower limit of ALS 66 (approximately 0 fL) to about 11 fL. For low ambient light, the desired display brightness may be calculated using the equation below:

$$\text{Display Brightness Low} = Ka+\left(\frac{Kb+Ka}{Ka}\right)\times\text{Contrast Ratio}\times\text{Ambient Light} \quad (4)$$

Ka is the brightness intercept point for the desired contrast ratio for a low ambient light level or is the minimum brightness level for a low ambient light level. Kb defines the slope that the display brightness changes for the contrast ratio based on the ambient light level. In one exemplary embodiment where display 70 includes an LCOS based image source, Ka may be less than about 0.1 and Kb may be less than about 1.0. In another exemplary embodiment using an LCOS based image source, Ka may be about 0.055 and Kb may be about 0.75. In other exemplary embodiments, display 70 may include other image sources and thus other Ka and Kb may have other values for optimizing the effectiveness of display 70 in low light conditions.

Referring to FIG. 5, the above equations (3) and (4) may be overlaid together on the same scale to form a total desired brightness response 400 to ambient light for a particular contrast setting, according to an exemplary embodiment. When low ambient light levels exist, the display brightness may be adjusted using equation (4) above and when normal ambient light levels exist, the display brightness may be adjusted using equation (3) above. Processing electronics 60 may calculate the desired display brightness using both equations (3) and (4). The higher desired display brightness of the two results may be used to command the actual display brightness of display 70 in response to the sensed ambient light. By selecting the higher of the two calculations, processing electronics 60 may make a smooth transition from low to normal ambient light or from normal to low ambient light and enhance the display for low ambient light conditions. In other exemplary embodiments, processing electronics may analyze the sensed ambient light level and determine which equation to calculate and use for adjusting the brightness of display 70.

According to various exemplary embodiments, equation (1) above may be used to define the Ambient Light quantity used in each of equations (2)-(4). Such a definition of ambient light leads to the following equations:

$$\text{Contrast Ratio}=1+(\text{Display Brightness}/10^{(\textit{Filtered Ambient Light Level}-1)}) \quad (5)$$

$$\text{Display Brightness}=(\text{Contrast Ratio}-1)\times 10^{(\textit{Filtered Ambient Light Level}-1)} \quad (6)$$

$$\text{Brightness} = Ka + \left(\frac{Kb + Ka}{Ka}\right) \times \text{Contrast Ratio} \times 10^{(\text{Filtered Ambient Light Level}-1)} \quad (7)$$

Figure 6:
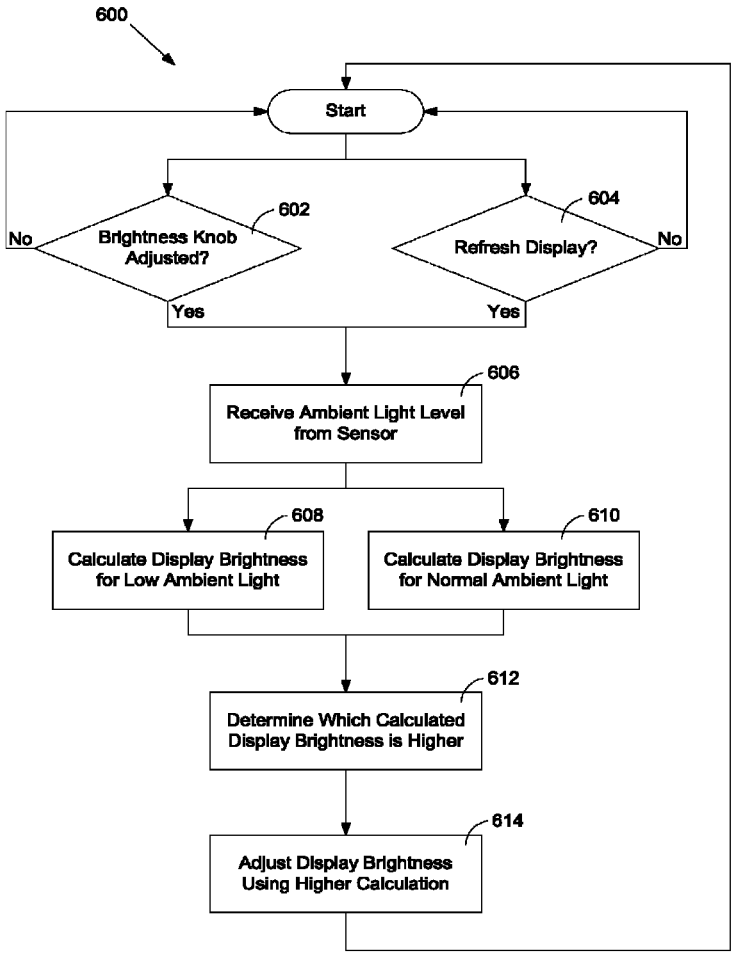
FIG. 6 is a block diagram illustrating a method for adjusting a display contrast ratio, according to an exemplary embodiment.

Referring to FIG. 6, a method 600 is configured to adjust the display brightness of display 70 based on an ambient light level near display 70 and based on a set contrast ratio for an automatic brightness control mode, according to an exemplary embodiment. If the display brightness knob is actuated by flight personnel to set the desired contrast ratio (step 602) or if it is time to refresh display 70, for example based on a display refresh rate (step 604), processing electronics 60 receives or retrieves a signal indicating an ambient level sensed by ALS sensor 66 (step 606). If the brightness knob is not adjusted and it is not time to refresh the display, method 600 waits until one of these events occurs. Based on the ambient light level, processing electronics 60 calculates the desired display brightness using both equation (4) and equation (3) (or equations (7) and (6)), for both low ambient light conditions (step 608) and normal ambient light conditions (step 610). Processing electronics 60 then determines which of the calculated display brightness has the higher value (step 612) and adjusts the brightness level of display 70 based on the higher display brightness (step 614) in order to maintain a constant contrast ratio. Thereafter, method 600 returns to the beginning until the next contrast ratio adjustment or display refresh time.

Figure 7:
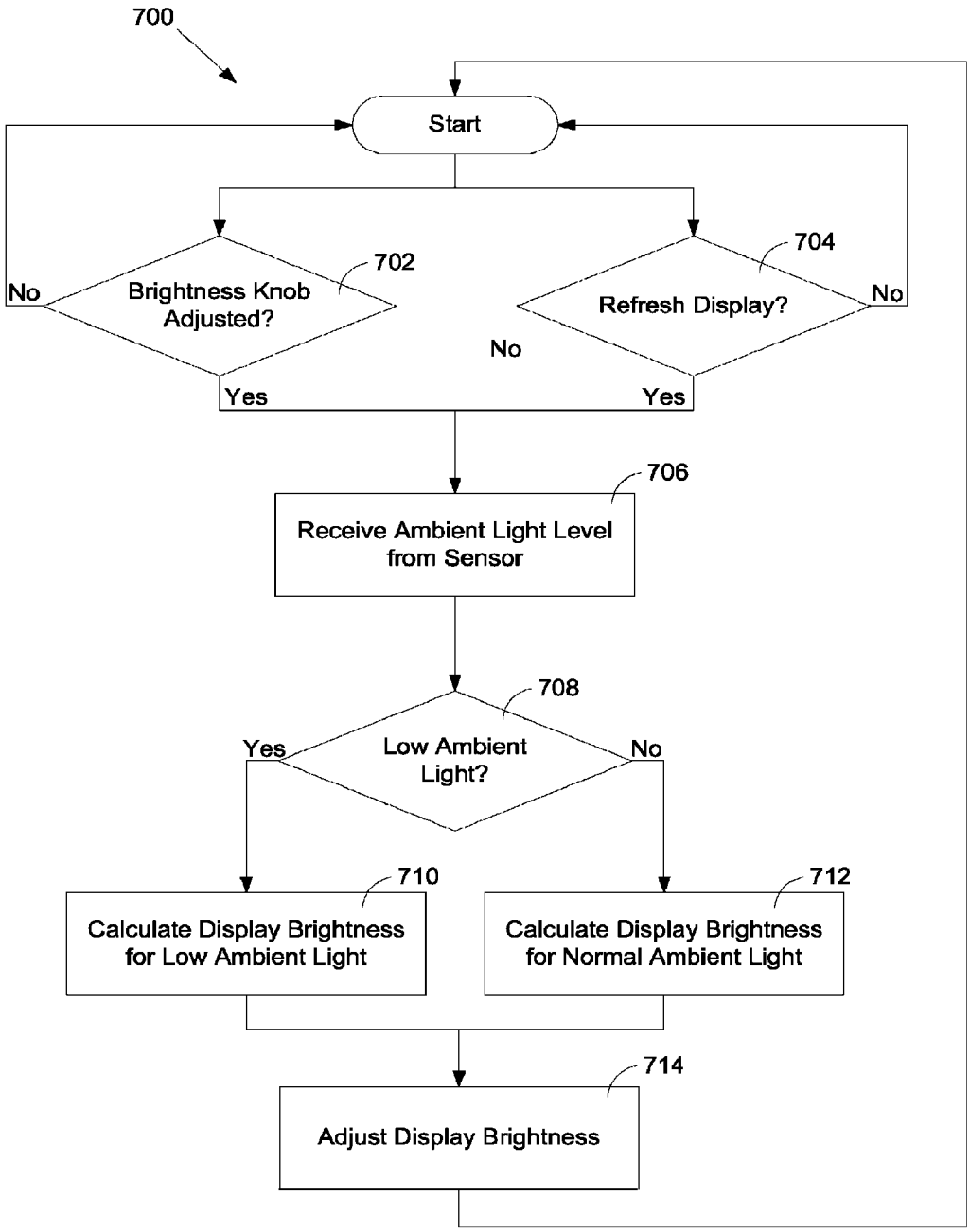
FIG. 7 is a block diagram illustrating a method for adjusting a display contrast ratio, according to another exemplary embodiment.

Referring to FIG. 7, a method 700 is configured to adjust the display brightness of display 70 based on an ambient light level near display 70 and a set contrast ratio for an automatic brightness control mode, according to another exemplary embodiment. If the display brightness knob is actuated by flight personnel to set a desired contrast ratio (step 602) or if it is time to refresh display 70, for example based on a display refresh rate (step 604), processing electronics 60 receives or retrieves a signal indicating an ambient level sensed by ALS sensor 66 (step 606). If the brightness knob is not adjusted and it is not time to refresh the display, method 600 waits until one of these events occurs. Processing electronics 60 determines whether the received ambient light level is below a predetermined threshold (e.g., below about 40 fL, below about 30 fL, etc.) and is a low ambient light level (step 708). If the ambient light level indicates a low ambient light level condition, processing electronics 60 calculates the display brightness using equation (4) or (7) for low ambient light (step 710). If the ambient light level does not indicate a low ambient light level condition, processing electronics 60 calculates the desired contrast ratio using equation (3) or (6) for normal ambient light (step 712). Processing electronics 60 then adjusts the brightness of display 70 based on the calculated display brightness in order to maintain a constant contrast ratio (step 714).

Exemplary embodiments may include program products comprising computer or machine-readable media for carrying or having machine-executable instructions or data structures stored thereon. For example, aircraft display system 30 may be computer driven. Exemplary embodiments illustrated in the methods of FIGS. 6-7 may be controlled by program products comprising computer or machine-readable media for carrying or having machine-executable instructions or data structures stored thereon. Such computer or machine-readable media can be any available media which can be accessed by a general purpose or special purpose computer or other machine with a processor. By way of example, such computer or machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of computer or machine-readable media. Computer or machine-executable instructions comprise, for example, instructions and data which cause a general purpose computer, special purpose computer, or special purpose processing machines to perform a certain function or group of functions. Software implementations of the present invention could be accomplished with standard programming techniques with rule based logic and other logic to accomplish the various connection steps, processing steps, comparison steps and decision steps.

It is also important to note that the construction and arrangement of the components as shown in the various exemplary embodiments is illustrative only. Although only a few embodiments have been described in detail in this disclosure, those skilled in the art who review this disclosure will readily appreciate that many modifications are possible (e.g., variations in dimensions, structures, shapes and proportions of the various elements, mounting arrangements, use of materials, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may be made in the design, operating conditions and arrangement of the various exemplary embodiments without departing from the scope of the present inventions as expressed in the appended claims.

What is claimed is:

1. An aircraft display system, comprising:

an electronic display configured to provide at least one of graphical and textual elements; and electronics configured to receive a signal indicating an ambient light level, the electronics setting a brightness of the display using a first calculation in response to a desired contrast ratio and the ambient light level, wherein the first calculation is based on the equation:

$$\text{Desired Display Brightness} = Ka + \left(\frac{Kb - Ka}{Ka}\right) \times \text{Desired Contrast Ratio} \times \text{Ambient Light},$$

wherein the Desired Display Brightness comprises the brightness of the display, the Desired Contrast Ratio comprises the desired contrast ratio, the Ambient Light comprises the ambient light level, Ka comprises a minimum brightness level, and Kb comprises a slope of the brightness of the display for the desired contrast ratio based on the ambient light level.

2. The display system of claim 1, further comprising:

a user interface configured to receive user input, the electronics configured to set the desired contrast ratio of the display in response to the user input and configured to provide a signal indicating the desired contrast ratio to the electronics.

3. The display system of claim 1, further comprising an ambient light sensor configured to sense the ambient light level in an area near the display, the ambient light sensor converting the sensed ambient light level to a voltage and providing the voltage to the electronics as the signal indicating the ambient light level.

4. The display system of claim 1, wherein the electronics is configured to use a second calculation in response to the desired contrast ratio and the ambient light level.

5. The display system of claim 4, wherein the electronics only calculates the first calculation if the ambient light level is below a predetermined threshold value and only calculates the second calculation if the ambient light level is above the predetermined threshold value, the electronics setting the brightness of the display using the performed calculation.

6. An aircraft display system, comprising:

an electronic display configured to provide at least one of graphical and textual elements; and electronics configured to receive a signal indicating an ambient light level, the electronics setting a brightness of the display using a first calculation in response to a desired contrast ratio and the ambient light level, and using a second calculation in response to the desired contrast ratio and the ambient light level, wherein the second calculation is based on the equation: Desired Display Brightness=(Desired Contrast Ratio−1)×Ambient Light, wherein the Desired Display Brightness comprises the brightness of the display, the Desired Contrast Ratio comprises the desired contrast ratio, and the Ambient Light comprises the ambient light level.

7. The display system of claim 6, wherein the first calculation is based on the equation:

$$\text{Desired Display Brightness} = Ka + \left(\frac{Kb - Ka}{Ka}\right) \times \text{Desired Contrast Ratio} \times \text{Ambient Light},$$

wherein the Desired Display Brightness comprises the brightness of the display, the Desired Contrast Ratio comprises the desired contrast ratio, the Ambient Light comprises the ambient light level, Ka comprises a minimum brightness level, and Kb comprises a slope that the brightness of the display for the contrast ratio based on the ambient light level.

8. The display system of claim 6, wherein the electronics compares the first calculation and the second calculation, the electronics setting the brightness of the display in using the calculation having the higher result.

9. The display system of claim 8, wherein the electronics calculates the first calculation and the second calculation simultaneously.

10. A method for setting a brightness of an aircraft display, comprising:

receiving a signal indicating an ambient light level at electronics;

receiving a signal indicating a desired contrast ratio for the display at the electronics; and setting a brightness of the display using the electronics, the electronics using a first calculation in response to the desired contrast ratio and the ambient light level wherein the first calculation is based on the equation: Desired Display Brightness=(Desired Contrast Ratio−1)×Ambient Light, wherein the Desired Display Brightness comprises the brightness of the display, the Desired Contrast Ratio comprises the desired contrast ratio, and the Ambient Light comprises the ambient light level.

11. The method of claim 10, further comprising:

receiving a user input at a user interface;

providing the user input to the electronics as the signal indicating the contrast ratio to the electronics; and setting the contrast ratio of the display in response to the user input using the electronics.

12. The method of claim 10, further comprising:

sensing the ambient light level in an area near the display using an ambient light sensor;

converting the sensed ambient light level to a voltage using the ambient light sensor; and providing the voltage from the ambient light sensor to the electronics as the signal indicating the ambient light level.

13. A method for setting a brightness of an aircraft display, comprising:

receiving a signal indicating an ambient light level at electronics;

receiving a signal indicating a desired contrast ratio for the display at the electronics; and setting a brightness of the display using the electronics, the electronics using a first calculation in response to the desired contrast ratio and the ambient light level, wherein the first calculation is based on the equation:

$$\text{Desired Display Brightness} = Ka + \left(\frac{Kb - Ka}{Ka}\right) \times \text{Desired Contrast Ratio} \times \text{Ambient Light},$$

wherein the Desired Display Brightness comprises the brightness of the display, the Desired Contrast Ratio comprises the desired contrast ratio, the Ambient Light comprises the ambient light level, Ka comprises a minimum brightness level, and Kb comprises a slope of the display brightness for the desired contrast ratio based on the ambient light level.

14. The method of claim 13, wherein setting the brightness uses a second calculation, wherein the second calculation is based on the equation: Desired Display Brightness=(Desired Contrast Ratio−1)×Ambient Light, wherein the Desired Display Brightness comprises the brightness of the display, the Desired Contrast Ratio comprises the desired contrast ratio, and the Ambient Light comprises the ambient light level.

15. The method of claim 13, further comprising:

comparing the first calculation and a second calculation using the electronics; and setting the brightness of the display using the electronics and using a higher result from the first calculation and the second calculation.

16. The method of claim 15, wherein the electronics calculates the first calculation and the second calculation simultaneously.

17. The method of claim 13, further comprising:

calculating the first calculation using the electronics only if the ambient light level is below a predetermined threshold value;

calculating a second calculation using the electronics only if the ambient light level is above the predetermined threshold value; and setting the brightness of the display using the performed calculation.

18. The method of claim 17, wherein the predetermined threshold is between 0 and 10.5 fL.

19. An aircraft display system, comprising:

means for receiving a signal indicating an ambient light level;

means for receiving a signal indicating a desired contrast ratio for the display; and means for setting a brightness of the display using a first calculation in response to the desired contrast ratio and the ambient light level and using a second calculation in response to the desired contrast ratio and the ambient light level, wherein the first calculation is based on the equation:

$$\text{Desired Display Brightness} = Ka + \left(\frac{Kb - Ka}{Ka}\right) \times \text{Desired Contrast Ratio} \times \text{Ambient Light},$$

wherein the Desired Display Brightness comprises the brightness of the display, the Desired Contrast Ratio comprises the desired contrast ratio, the Ambient Light comprises the ambient light level, Ka comprises a minimum brightness level, and Kb comprises a slope of the display brightness for the desired contrast ratio based on the ambient light level, wherein the second calculation is based on the equation: Desired Display Brightness=(Desired Contrast Ratio−1)×Ambient Light, wherein the Desired Display Brightness comprises the brightness of the display, the Desired Contrast Ratio comprises the desired contrast ratio, and the Ambient Light comprises the ambient light level.

20. The system of claim 19, further comprising:

means for comparing the first and second calculations; and means for setting the brightness of the display using the calculation having the higher result.

* * * * *